United States Patent [19]

Edwards et al.

[11] 4,185,130

[45] Jan. 22, 1980

[54] MAGNETIC IMAGE DECORATOR

[75] Inventors: Donald W. Edwards, Wilmington; Richard D. Kinard, Newark; Theodore J. Wirbisky, Wilmington, all of Del.; Richard J. Angelucci, Glenolden, Pa.

[73] Assignee: E. I. Du Pont de Nemours and Company, Wilmington, Del.

[21] Appl. No.: 788,668

[22] Filed: Apr. 18, 1977

[51] Int. Cl.[2] ..... B05D 5/00; B05D 3/14

[52] U.S. Cl. ..... 427/47; 427/145; 427/199; 427/256

[58] Field of Search ..... 427/47, 48, 145, 199, 427/256; 118/657

[56] References Cited

U.S. PATENT DOCUMENTS

| | | | |
|---|---|---|---|
| 3,543,720 | 12/1970 | Drexler et al. | 118/637 |
| 3,552,355 | 1/1971 | Flint | 118/627 |
| 3,645,770 | 2/1972 | Flint | 117/17.5 |
| 3,703,395 | 11/1972 | Drexler et al. | 427/47 |
| 3,707,390 | 12/1972 | Sullivan | 427/47 |
| 4,051,484 | 9/1977 | Martin | 427/47 |

*Primary Examiner*—Bernard D. Pianalto

[57] ABSTRACT

A magnetic image decorator is disclosed wherein two or more rotatable cylindrical magnetic augers disposed in a sump of magnetically attractable toner are used in conjunction with cooperating knife blades to decorate a surface containing a latent magnetic image and to distribute and redistribute toner particles to maintain a level sump.

5 Claims, 5 Drawing Figures

MAGNETIC IMAGE DECORATOR

BACKGROUND OF THE INVENTION

In the past various techniques have been used to apply magnetically attractable toner particles to a latent magnetic image. Generally this has been achieved by cascading the magnetically attractable toner particles over the latent magnetic image such as in the manner disclosed in U.S. Pat. No. 3,698,005. An alternate technique is disclosed in U.S. Pat. No. 3,640,247 wherein a non-magnetizable tube containing a rotatable row of bar magnets is used to deliver toner particles from a sump to a shelf adjacent a drum having a latent magnetic image in the surface thereof.

The present invention relates to an apparatus and method for applying magnetically attractable toner particles to a latent magnetic image in such a way that a very wide range of imaging surface velocities can be achieved with excellent uniformity and image density across the width of latent magnetic images much wider than hitherto achieved.

SUMMARY OF THE INVENTION

In accordance with the present invention an apparatus and method is provided for decorating a latent magnetic image with magnetically attractable toner particles. The invention involves providing at least a pair of magnetic augers each cooperating with a knife blade which interrupts a layer of toner particles on the magnetic auger and fluidizes the toner particles into a fluidized standing wave of particles which contact a latent-magnetic-image-bearing surface thereby decorating said image with toner particles.

BRIEF DESCRIPTION OF THE DRAWING

Referring to FIG. 1, the translucent document such as an engineering drawing which is to be copied, is placed on shelf 11 and urged against gate 12. The copier is then activated to lift gate 12 and lower feed roll 13 into contact with the document. Feed roll 13 feeds the document into the nip between endless belt 14 and drum 15. Endless belt 14 is made of a transparent film such as poly(ethylene terephthalate) film and is guided by rolls 16, 17, and 18. he surface of drum 15 may also be such a film coated with an electrically conductive layer which is grounded. The surface of the electrically conductive layer is coated with a layer of ferromagnetic material having a Curie point of from 25° to 500° C. such as acicular chromium dioxide in an alkyd or other suitable binder.

Figure 1:
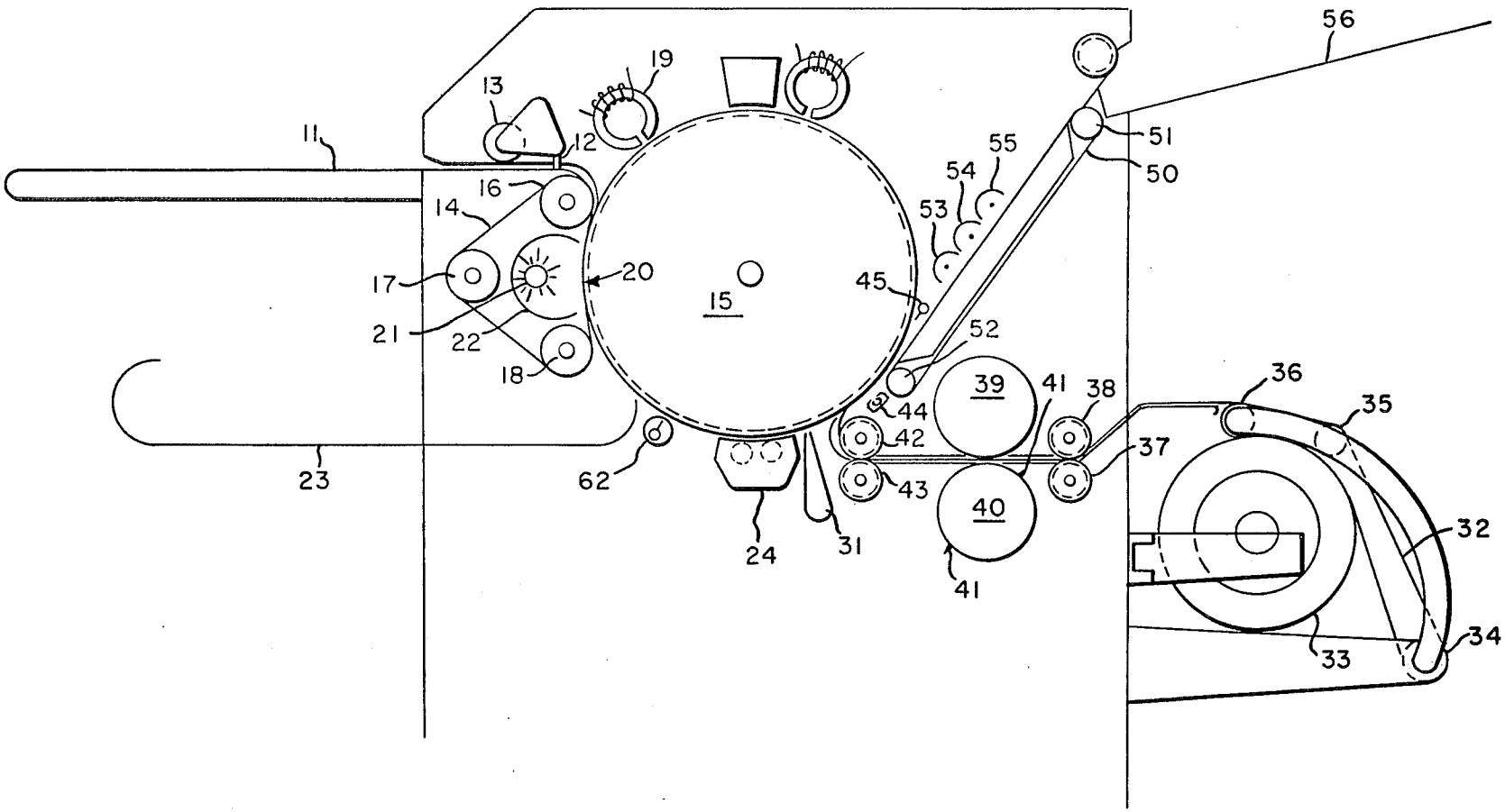
FIG. 1 is a schematic view of one embodiment of a printer using the decorator of the present invention.

Drum 15 rotates in a counterclockwise direction. The ferromagnetic coating on the drum is uniformly magnetized by premagnetizer 19, which records a spatial periodic magnetic pattern. From 250 to 1500 magnetic reversals per inch on the magnetizable surface is a suitable working range with from 300 to 600 magnetic reversals per inch being preferred. Then the magnetized drum surface in contact with the document is moved past exposure station indicated generally at 20. The exposure station consists of lamp 21 and reflector 22. The surface of drum 15 is exposed stepwise until the entire document has been recorded as a latent magnetic image on the surface of drum 15. The chromium dioxide as used herein has a Curie temperature of about 116° C. Various indicia on the document such as pencil lines and printing being copied shade the areas of chromium dioxide over which such indicia are situated during exposure, thereby preventing their reaching the Curie point. Thus, after exposure, the surface of drum 15 will have magnetized areas of chromium dioxide corresponding to the indicia bearing areas of the document being copied, other areas not so shaded being demagnetized.

After exposure, the document being copied is dropped into tray 23.

The imagewise magnetized drum 15 is rotated past a toner decorator 24. The toner decorator is shown in detail in FIGS. 2 and 3. The toner is a fine powder of a magnetic material such as iron oxide encapsulated in a thermoplastic resin having a relatively low softening point of from 75° to 120° C. The toner generally will have an average particle size of from 10 to 30 microns. A vacuum knife 31 is used to remove whatever toner particles may have adventitiously become attached to the demagnetized areas of the chromium dioxide on the surface of drum 15. The paper 32 on which the copy is to be made is fed from roll 33 around idler rolls 34, 35, and 36 to feed rolls 37 and 38. Backing roll 39 cooperates with roll 40 equipped with cutting edges 41. Rolls 39 and 40 are activated by means not shown to cut the paper to the same length as the length of the document being copied. The paper is then fed into physical contact with the surface of drum 15 by rolls 42 and 43. The paper 32 in contact with the surface of drum 15 is fed past corona discharge device 44. Corona discharge device 44 preferably is of the type known as a Corotron which comprises a corona wire spaced about 11/16" (17.5 mm) from the paper and a metal shield around about 75 percent of the corona wire leaving an opening of about 90° around the corona wire exposed facing paper 32. The metal shield is insulated from the corona wire. The metal shield is maintained at ground potential. Generally the corona wire will be from 0.025 to 0.25 mm in diameter and will be maintained at from 3000 to 10,000 volts. The corona wire may be at either a negative or positive potential with negative potential being preferred. The corona discharge from the wire charges the backside of the paper. Upon separation of paper 32 from drum 15 said toner particles remain held in image-wise fashion to paper 32. There is only a light amount of pressure between paper 32 and the surface of drum 15 (i.e., merely enough to hold them adjacent each other). The pressure between paper 32 and drum 15 is essentially entirely generated by the electrostatic attraction generated by corona discharge device 44. The paper 32 is then removed from the surface of drum 15 by the action of vacuum belt 50 in conjunction with the action of puffer 45 that forces it onto the surface of endless vacuum belt 50 driven by rollers 51 and 52. The paper 32 is then fed under fusers 53, 54, and 55 which heat the thermoplastic resin encapsulating the ferromagnetic material in the toner particles causing them to melt and fuse to the paper 32. The copy is then fed into tray 56.

Figure 2:
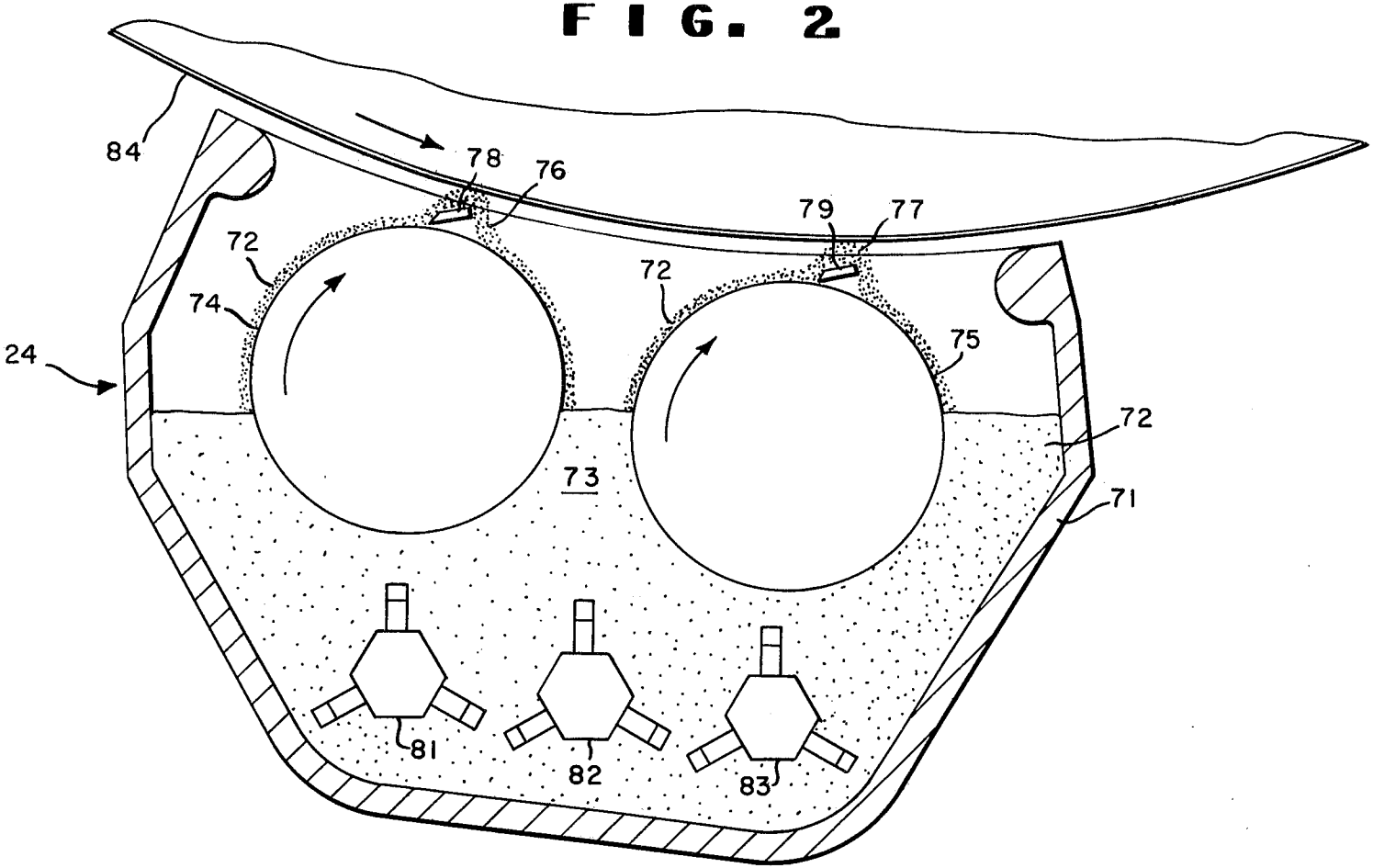
FIG. 2 is a cross-sectional elevation of the decorator of the present invention.

Referring now to FIG. 2, decorator 24 comprises a decorator tray 71 which is partially filled with toner particles 72 to form a toner sump 73. Each of the magnetic augers 74 and 75 picks up a layer of toner particles 72 and forms a wave of fluidized toner 76 and 77 under the action of knife blades 78 and 79. A magnetic auger is a magnetic roll or cylinder having one or more magnetic helices in the surface thereof which upon rotation transports ferromagnetic particles both circumferentially and axially. There is no transfer of the layer of toner particles from one magnetic auger to the other, excess toner particles being returned to sump 73 or carried around. Sump 73 is kept stirred by agitators 81, 82 and 83. These are operated at a speed maintaining a well stirred sump without clumping and without excess dusting.

In decorating images we operate the magnetic augers 74 and 75 at a speed which yields fluidization of the toner wave which has then a well defined shape, but which does not create excess dusting. We find that, with a properly fluidized wave of toner, a wide range of velocities of imaging surface 84 can be accommodated (i.e., 30 to 150 feet per minute (15 to 76 cm/second).

The fluidized wave we produce is characterized by a stable, constant cross-section, uniform in height, and without significant oscillation or undulation. The wave is a standing wave and the toner material at the crest moves substantially co-current with the surface bearing the latent image. In this region at the crest the toner particles are highly fluidized but have low kinetic energy and are removed from the influence of the magnetic roll (and thus readily influenced by the magnetic latent image).

Figure 3:
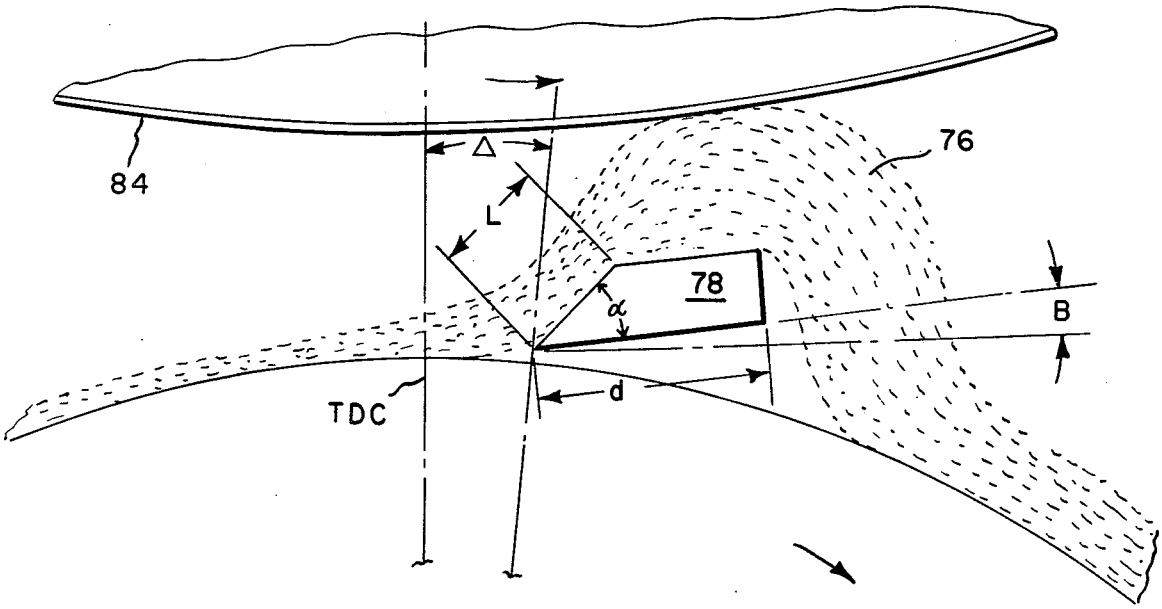
FIG. 3 is an enlarged view of that portion of FIG. 2, at which image decoration occurs.

Parameters which are important in producing such a preferred fluidized wave are:

- Magnetic Auger
  - Magnetic strength
  - Surface Velocity
  - Depth of toner layer
- Blade
  - Wetted length
  - Angle to magnetic auger
  - Position on magnetic auger
  - Clearance to magnetic auger
- Toner
  - Flowability Referring to FIG. 3, the shape of the knife blade 78 is seen in cross-section as a wedge with an edge angle, "$\alpha$", a wedge face (wetted length "L") and a blade length "d". For a surface speed of 30 to 150 feet per minute (15 to 76 cm per second) of imaging surface 84 (drum) and using augers having surfaces with a field strength of about 480 Gauss and a diameter of about 2 inches (5 cm) angle "$\alpha$" may be varied from 30° to 45°. We prefer 30° for our preferred 60 surface feet per minute (30 cm per second) magnetic auger surface. Wedge face "L" which is dependent on surface velocity of the magnetic auger and toner flow characteristics, may be from about 1/16 to about $\frac{1}{4}$ inch (1.6 to 6.4 mm) with $\frac{1}{8}$ inch (3.2 mm) preferred. Face "L" is shown as a flat surface which we prefer, but it also may be either concave or convex. Blade length "d" may be from about $\frac{1}{8}$ to about $\frac{3}{8}$ inch (3.2 to 9.6 mm) with $\frac{1}{4}$ inch (6.4 mm) preferred. The blade is held under tension. Blade to roll clearance should be minimized. Runout limits practical value to from about 2 to about 5 mils (51 to 127 microns).

Again, referring to FIG. 3, the preferred position of blade 7 has been found to depend on magnetic auger surface velocity, toner flow characteristics, and is, in the figure, delineated by position angle "Δ" and attitude angle "B". We prefer to set position angle "Δ" at 15° from Top Dead Center of the magnetic auger in the direction of motion of its surface as shown in FIG. 3 when operating at our preferred magnetic auger surface velocity of 60 feet per minute (30 cm per second). In order to form a stable standing wave of fluidized toner without excessive dusting at higher surface velocities of the magnetic auger, we find it necessary to shift angle "Δ" to as much as −15°. Conversely at lower surface velocities we shift angle "Δ" to as much as about +30°. Similarly, attitude angle "B" is varied from 0° to 30° with 10° preferred. Since these settings "Δ" and "B" are sensitive to toner characteristics, they are best determined experimentally as is the amount of penetration of the imaging surface 84 into the fluidized wave of toner 76'. In this latter instance, we find that under 0.025 inch (0.625 mm) penetration yields sparse and non-uniform decoration and over 0.100 inch (2.54 mm) penetration yields an unacceptable increase in background. For our preferred imaging surface velocity of about 60 feet per minute (30 cm per second), we prefer a penetration of about 0.050 inch (1.27 mm).

We have found that a two roll decorator as described, employing the magnetic auger action of the opposed helical wraps of magnetic rubber, makes excellent reproductions of engineering drawings and the like which have lines thick and thin, heavy and light, as well as hand lettered, typed and conventionally printed material. In reproductions of this type, the original documents are quite large, 36″×44″ (88×102 cm) is a typical size "E" drawing. The invention uniformly decorates a latent image of such a drawing across its width in a superior manner.

Figure 4:
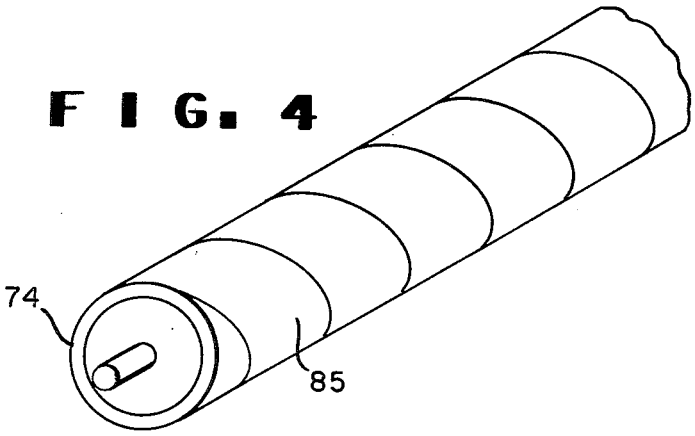
FIG. 4 is a perspective view of one of the magnetic augers shown in FIG. 3.
Figure 5:
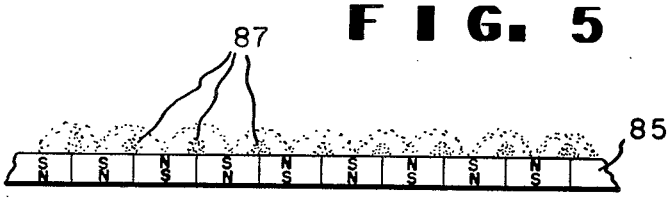
FIG. 5 is a cross-section of the roll covering taken on line IV—IV of FIG. 4.

A preferred construction of magnetic auger 74 is shown in FIG. 4. In this instance magnetic auger 74 is fabricated by surfacing a suitably journalled roll with a helically wound strip of magnetic elastomer or magnetic polymeric sheet material 85 to form a smooth circumferential surface. Such flexible magnetic sheet materials are well-known and commercially available. The preferred sheet material is permanently magnetized and has a pressure sensitive adhesive on one side. The preferred sheet material has north-south magnetic poles through the thickness and spaced about 8 to the inch (3.1 per cm) as shown in FIG. 5. In order to obtain the desired pitch for the magnetic helices it is preferred that the lines of magnetization be oriented parallel to the long direction of the strip of magnetic sheet being used to form the magnetic auger. Strips of magnetic sheet with lines transverse to the long direction of the strips form interrupted helices which, while workable are less preferred. The width of the tape used is two inches (5 cm) and the resultant helix angle when wound on a two inch (5 cm) diameter roll has been found satisfactory. Thus, when the strip 85 is helically wound about auger 4 sixteen magnetic helices are created.

As shown in FIG. 5, the particulate ferromagnetic material forms raised bands 87 over the intersections of the magnetic poles which are helically disposed about the auger. The ferromagnetic material closest to the pole intersection in the strip of magnetic material is the most tightly bound which in FIG. 5 is indicated schematically by density of shading. The interaction of the helical disposition of the magnetic bands 87 and the ferromagnetic particles 72 in the sump 73 produces a forwarding force parallel to the rotational axis of the auger. The direction of this force, of course, depends on the direction of rotation and the hand of the helical wrap. The magnitude of the pumping action so provided varies directly with the revolutions per minute of the auger and with the immersion of the auger in the ferromagnetic particles. The rotating magnetic auger partially immersed in a sump of ferromagnetic particles is capable of moving the ferromagnetic particles in a controllable direction at a controllable rate. The magnetic auger, despite its essentially cylindrical geometry, acts as though it were formed in typical screw fashion and the bands of particles 87 act like screw flights. Thus, by using a left hand helix of magnetic material in auger 74 and a right hand helix of magnetic material in auger 75 toner is pumped in a large end to end loop. Since the quantity of toner pumped at high spots is greater than at low spots, there is a continuous end-to-end self-leveling action.

This self-leveling action provides a uniform sump height for the magnetic rolls to draw from. Thus, the layer of toner on the roll is uniform in thickness and a uniform fluidized wave is formed end to end. We are thus able to employ wide decorator rolls, i.e., in excess of 36 inches (89 cm). Where a heavy image tends to deplete the sump locally, the leveling action prevents this localized depletion of toner and consequent loss of image decoration. Moreover, replenishment of toner can be done at one point, say near the roll end, and the leveling action uniformly distributes the toner.

We claim:

1. A process of applying magnetically attractable toner particles to a surface containing a latent magnetic image comprising supplying said toner particles to at least two rotating cylinders each having at least one magnetic helix in the surface thereof said helices and said rotations cooperating to cause said toner particles to flow axially and circumferentially, and causing said toner particles to flow in a fluidized standing wave over doctor knives disposed between each of said rotating cylinders and said surface whereby a portion of said magnetically attractable toner particles come into contact with and are magnetically held by said surface containing a latent magnetic image.

2. The process of claim 1 wherein the knife blades are from about $\frac{1}{8}$ to about $\frac{3}{8}$ inch in width.

3. The process of claim 2 wherein the edge angle of each of the knife blades engaging the toner particles is from about 30° to about 45°.

4. The process of claim 3 wherein the edge of each of the knife blades engaging the toner particles is from about 15° before to about 30° after Top Dead Center of the rotating cylinder.

5. The process of claim 4 wherein there are two cylinders each having a magnetic helix in the surface thereof, both rotating in the same direction, and the magnetic helix in one cylinder is a left hand spiral and the magnetic helix in the other cylinder is a right hand spiral.

* * * * *